US012338807B2

(12) United States Patent
Kim et al.

(10) Patent No.: US 12,338,807 B2
(45) Date of Patent: Jun. 24, 2025

(54) RECIPROCATING COMPRESSOR

(71) Applicant: LG ELECTRONICS INC., Seoul (KR)

(72) Inventors: Younghwan Kim, Seoul (KR); Youngboo Son, Seoul (KR); Seokjong Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 245 days.

(21) Appl. No.: 18/144,345

(22) Filed: May 8, 2023

(65) Prior Publication Data

US 2023/0407859 A1 Dec. 21, 2023

(30) Foreign Application Priority Data

Jun. 16, 2022 (KR) ..... 10-2022-0073622

(51) Int. Cl.
*F04B 39/00* (2006.01)
*F04B 39/12* (2006.01)

(52) U.S. Cl.
CPC ..... *F04B 39/0061* (2013.01); *F04B 39/123* (2013.01)

(58) Field of Classification Search
CPC F04B 39/0061; F04B 39/123; F04B 39/0055; F04B 39/023; F04B 39/04; F04B 39/0005; F04B 39/121; F04B 39/122; F05B 2210/14; F05B 2260/96; F05B 2280/4003
See application file for complete search history.

(56) References Cited

U.S. PATENT DOCUMENTS 5,201,640 A * 4/1993 Heinzelmann ..... F02M 35/1227 181/403
5,452,991 A 9/1995 Kita et al.
2009/0038329 A1* 2/2009 Alvarenga ..... F04B 39/0066 62/296

(Continued)

FOREIGN PATENT DOCUMENTS

EP 3 343 035 7/2018
EP 3343035 A1 * 7/2018 ..... F04B 35/045

(Continued)

OTHER PUBLICATIONS

European Search Report issued in Application No. 23178959.5 dated Aug. 2, 2023.

(Continued)

*Primary Examiner* — Emmanuel E Duke
(74) *Attorney, Agent, or Firm* — KED & ASSOCIATES

(57) ABSTRACT

A reciprocating compressor may include a discharge muffler that attenuates discharge noise of a discharge gas discharged after being compressed in a cylinder of a compression unit, and two or more discharge hoses coupled to the discharge muffler and that discharges the discharge gas outside of the compression unit through a discharge pipe. As the reciprocating compressor has two or more discharge hoses that connect the discharge muffler and the discharge pipe, while a rigidity is reduced by reducing an inner diameter of the discharge hose, clogging of the discharge gas during high-speed operation may be suppressed or prevented and pulsation may be effectively reduced.

20 Claims, 12 Drawing Sheets

(56) References Cited

U.S. PATENT DOCUMENTS

| | | | | |
|---|---|---|---|---|
| 2009/0068029 | A1* | 3/2009 | Brabek | F04B 39/122<br>417/312 |
| 2011/0014065 | A1* | 1/2011 | Park | F04B 39/0061<br>417/312 |
| 2014/0322040 | A1* | 10/2014 | Cho | F04B 39/125<br>417/312 |
| 2018/0223825 | A1* | 8/2018 | Cho | F16L 17/063 |

FOREIGN PATENT DOCUMENTS

| | | | | |
|---|---|---|---|---|
| EP | 3 599 378 | | 1/2020 | |
| EP | 3599378 | A1 * | 1/2020 | F04B 39/0055 |
| KR | 10-1999-0031724 | | 5/1999 | |
| KR | 20180019139 | A * | 2/2017 | F04B 30/0005 |
| KR | 10-2017-0117952 | | 10/2017 | |
| KR | 20170117974 | A * | 10/2017 | F04B 39/0044 |
| KR | 101865517 | B1 * | 6/2018 | |
| KR | 20180067147 | A * | 6/2018 | F04B 30/0238 |

OTHER PUBLICATIONS

Korean Office Action dated Oct. 18, 2023 issued in Application No. 10-2022-0073622.

* cited by examiner

RECIPROCATING COMPRESSOR

CROSS-REFERENCE TO RELATED APPLICATION(S)

This application claims priority to and the benefit of Korean Patent Application No. 10-2022-0073622, filed in Korea on Jun. 16, 2022, whose entire disclosure is hereby incorporated by reference.

BACKGROUND

1 Field

A reciprocating compressor, and more particularly, a reciprocating compressor having an improved structure of a discharge hose connecting a discharge muffler and a discharge pipe is disclosed herein.

2. Background

In general, a hermetic compressor is a compressor that includes a motor that generates power inside of an airtight container and a compression unit operating by receiving power from the motor. The hermetic compressor may be classified into a reciprocating type, a rotary type, a vane type, or a scroll type, for example, according to a method of compressing a refrigerant, which is a compressible fluid.

The reciprocating compressor is a type in which a crankshaft is coupled to a rotor of a motor, a connecting rod is coupled to the crankshaft, and a piston coupled to the connecting rod compresses refrigerant while linearly reciprocating inside of a cylinder. The reciprocating compressor includes an airtight container forming an airtight space, a motor provided in the airtight container and performing rotational motion, a compression unit installed on an upper side of the motor and receiving a rotational force of the motor and compressing the refrigerant, a suction part that suctions the refrigerant and supplies it to the compression unit, and a discharge part that discharges the refrigerant compressed in the compression unit.

The discharge part includes a discharge muffler that attenuates discharge noise of the refrigerant discharged, a discharge pipe fixed to the airtight container and made of metal, and a discharge hose made of a metal material and connecting the discharge muffler and the discharge pipe. However, when the discharge hose is made of the metal material, there is a problem in that vibration of the compressor body is transmitted to the airtight container through the discharge hose.

As a method for solving this problem, conventionally, it has been proposed a method of forming the discharge hose with a flexible material. However, as a vibration frequency of the compressor body increases when the reciprocating compressor is miniaturized, there is a limit to reducing the vibration of the airtight container even if the discharge hose is made of the flexible material. A miniaturized compressor, that is, a micro-compressor may be referred to as a compressor having at least one of width, depth, and height of 110 mm or less based on a size of an airtight container.

As another method for solving the above problem, it has been proposed a method of reducing a diameter of the discharge hose made of metal in the related art. However, in this case, there is a limitation in forming a thin discharge hose through which high-pressure discharge gas flows, so the diameter of the discharge hose must be reduced as a method of reducing the inner diameter of the discharge hose.

Therefore, as clogging of the discharge gas occurs during high-speed operation of the compressor, there is a problem in that a cooling capacity cannot be effectively increased as much as the speed of the compressor is increased. That the compressor is operated at high speed means that an operating speed of the compressor is 85 rps or more.

BRIEF DESCRIPTION OF THE DRAWINGS

Embodiments will be described in detail with reference to the following drawings in which like reference numerals refer to like elements, and wherein.

DETAILED DESCRIPTION

Figure 1:
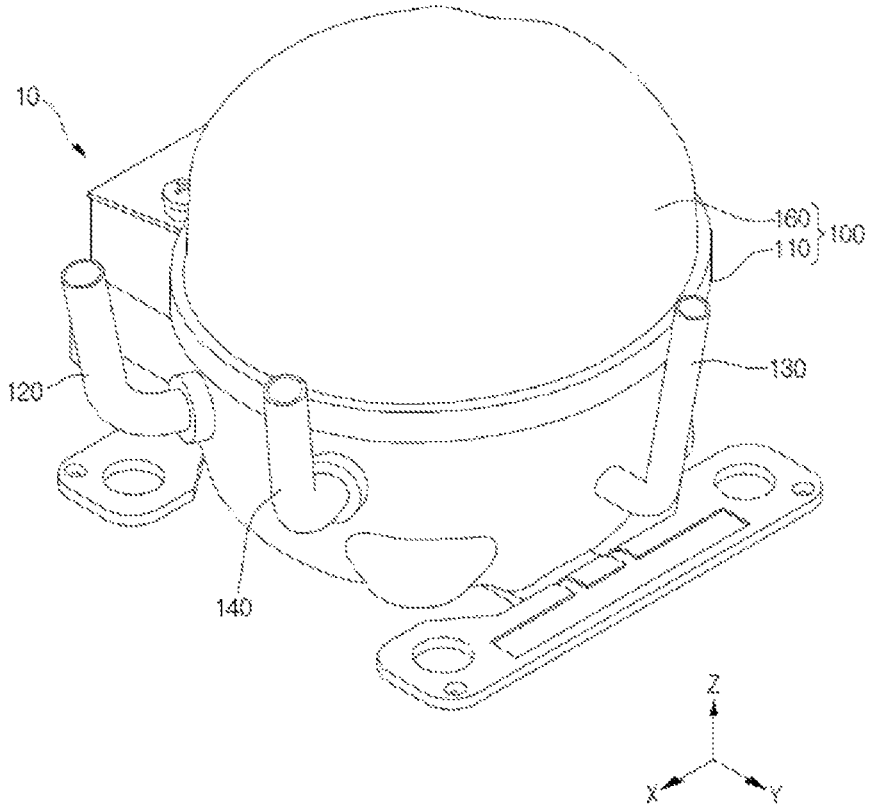
FIG. 1 is a perspective view of a reciprocating compressor according to an embodiment.

Hereinafter, embodiments will be described with reference to the accompanying drawings. However, regardless of the reference numerals, the same or similar components will be given the same reference numerals and redundant description thereof will be omitted.

The suffixes "assembly" and "unit" for elements used in the following description are given or mixed in consideration of only the ease of writing the specification, and do not have distinct meanings or roles by themselves.

In addition, in describing embodiments, when it is determined that description of the related known technology may obscure the subject matter of the embodiments, description thereof will be omitted.

In addition, the accompanying drawings are only for easily understanding the embodiments disclosed herein, the technical spirit disclosed is not limited by the accompanying drawings, and it should be understood that the accompanying drawings include all changes, equivalents, and substitutes included in the spirit and scope of the present disclosure.

While terms, such as "first", "second", etc., may be used to describe various elements, such elements must not be limited by the above terms. The above terms are used only to distinguish one element from another.

When an element is referred to as being "coupled" or "connected" to another element, it may be directly coupled to or connected to the other element, however, it should be understood that other elements may exist in the middle.

On the other hand, when an element is referred to as being "directly coupled" or "directly assembled" to another element, it should be understood that there are no other elements in the middle.

The singular forms are intended to include the plural forms as well, unless the context clearly indicates otherwise.

In addition, in embodiments, it should be understood that the terms "comprise" and "have" specify the presence of stated features, integers, steps, operations, elements, parts, or combinations thereof, but do not preclude the presence or addition of one or more other features, integers, steps, operations, elements, parts, or combinations thereof.

Hereinafter, a reciprocating compressor according to an embodiment disclosure will be described with reference to the accompanying drawings.

Figure 2:
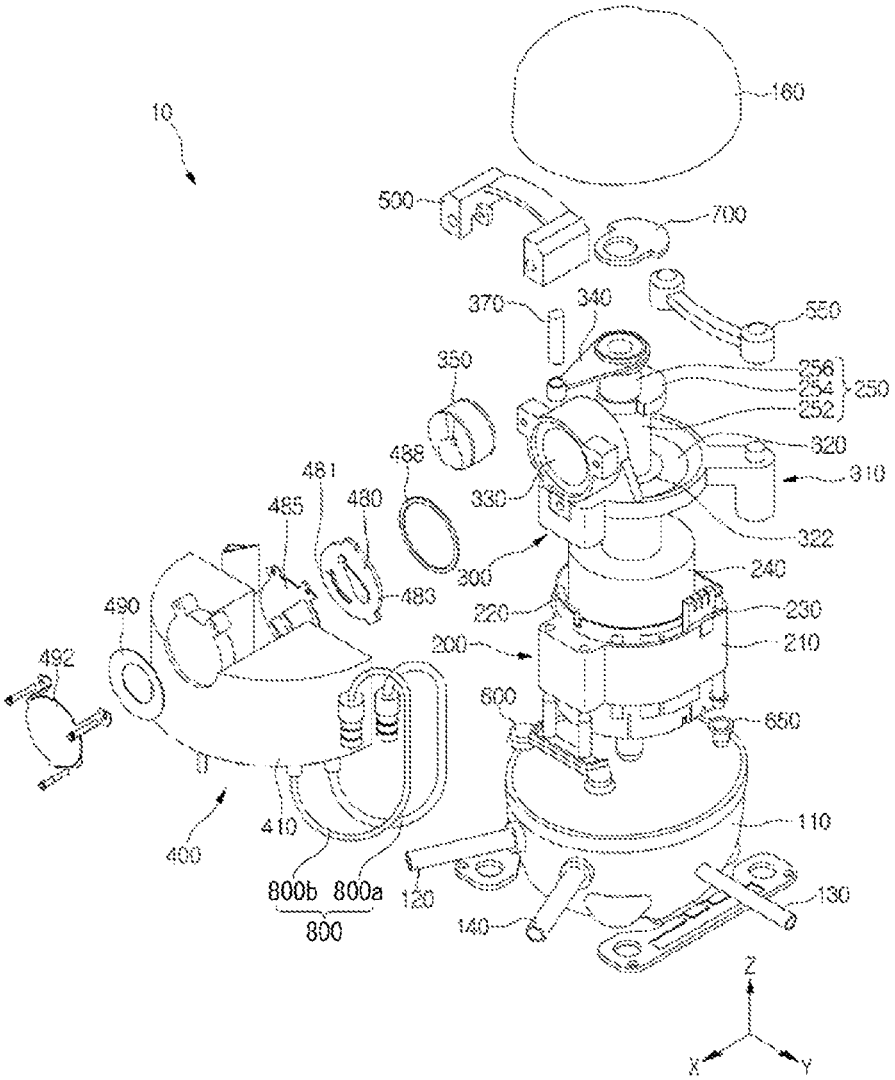
FIG. 2 is an exploded perspective view of a reciprocating compressor according to an embodiment.
Figure 3:
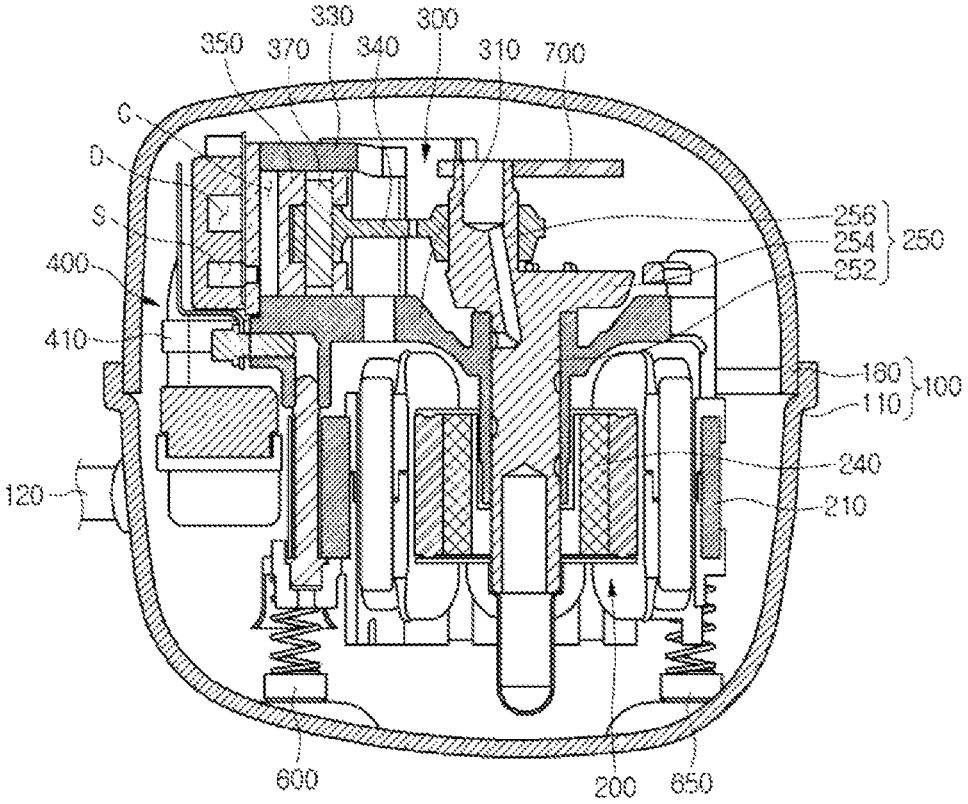
FIG. 3 is a cross-sectional view of a reciprocating compressor according to an embodiment.

FIG. 1 is a perspective view of a reciprocating compressor according to an embodiment. FIG. 2 is an exploded perspective view of a reciprocating compressor according to an embodiment. FIG. 3 is a cross-sectional view of a reciprocating compressor according to an embodiment.

Referring to FIGS. 1 to 3, a reciprocating compressor 10 according to an embodiment may include an airtight container 100 forming an exterior, a motor 200 provided in an inner space of the airtight container 100 and providing a drive force, a compression unit 300 that receives the drive force from the motor 200 and compresses a refrigerant through linear reciprocating motion, and a suction/discharge unit 400 that suctions the refrigerant for refrigerant compression of the compression unit 300 and discharges the refrigerant compressed from the compression unit 300. The airtight container 100 forms an airtight space therein, and accommodates various components of the compressor 10 within this airtight space. The airtight container 100 is made of a metal material and includes a lower airtight container 110 and an upper airtight container 160.

The lower airtight container 110 has a substantially hemispherical shape, and forms an accommodation space that accommodates various components forming the motor 200, the compression unit 300, the discharge unit 400, and the compressor 10 with the upper airtight container 160. The lower airtight container 110 may be referred to as a "compressor body" and the upper airtight container 160 may be referred to as a "compressor cover".

The lower airtight container 110 may include a suction pipe 120, a discharge pipe 130, a process pipe 140, and a power supply unit (not shown). A refrigerant flows into the airtight container 100 through the suction pipe 120, which is mounted through the lower airtight container 110. The suction pipe 120 may be separately mounted on the lower airtight container 110 or formed integrally with the lower airtight container 110.

The discharge pipe 130 discharges the refrigerant compressed in the airtight container 100 and may be mounted through the lower airtight container 110. The discharge pipe 130 may also be mounted separately to the lower airtight container 110 or formed integrally with the lower airtight container 110.

A discharge hose 800 of the suction/discharge unit 400 described hereinafter may be connected to the discharge pipe 130. The refrigerant flowing into the suction pipe 120 and compressed through the compression unit 300 may be discharged to the discharge pipe 130 via the discharge hose 800 of the suction/discharge unit 400.

The process pipe 140 is a device provided to charge a refrigerant into the airtight container 100 after sealing the inside of the airtight container 100, and may be mounted through the lower airtight container 110 together with the suction pipe 120 and the discharge pipe 130.

The upper airtight container 160 forms an accommodation space together with the lower airtight container 110, and may be formed in a substantially hemispherical shape like the lower airtight container 110. The upper airtight container 160 packages the lower airtight container 110 on an upper side of the lower airtight container 110 to form an airtight space therein.

The motor 200 may include stators 210 and 220, an insulator 230, a rotor 240, and a rotational shaft 250. The stators 210 and 220 are fixed components during driving of the motor 200, and may include a stator core 210 and a stator coil 220.

The stator core 210 is made of a metal material and may have a substantially cylindrical shape having an inner hollow. The stator coil 220 is mounted inside of the stator core 210. When power is applied from the outside, the stator coil 220 generates electromagnetic force to perform electromagnetic interaction with the stator core 210 and the rotor 240. Through this, the motor 200 may generate a drive force for reciprocating motion of the compression unit 300.

The insulator 230 may be disposed between the stator core 210 and the stator coil 220, and prevents direct contact between the stator core 210 and the stator coil 220. When the stator coil 220 is in direct contact with the stator core 210, as generation of electromagnetic force from the stator coil 220 may be hindered, this is to be prevented. The insulator 230 may separate the stator core 210 and the stator coil 220 by a predetermined distance from each other.

The rotor 240 may be rotatably provided inside of the stator coil 220 and may be installed in the insulator 230. The rotor 240 is provided with a magnet. The rotor 240 rotates through electromagnetic interaction with the stator core 210 and the stator coil 220 when power is supplied from the outside. A rotational force according to rotation of the rotor 240 acts as a drive force capable of driving the compression unit 200.

The rotational shaft 250 may be installed in the rotor 240, mounted to pass through the rotor 240 in a vertical direction, and rotate together with the rotor 240. Also, the rotational shaft 250 may be connected to a connecting rod 340 described hereinafter, and transmit the rotational force generated from the rotor 240 to the compression unit 300.

The rotational shaft 250 may include a base shaft 252, a rotational plate 254, and an eccentric shaft 256. The base shaft 252 may be mounted in the rotor 240 in an upward and downward direction (Z-axis direction) or in the vertical direction. When the rotor 240 rotates, the base shaft 252 may rotate together with the rotor 240.

The rotational plate 254 may be installed on one side of the base shaft 252, and may be rotatably mounted on a rotational plate seating part or seat 320 of a cylinder block 310. The eccentric shaft 256 may protrude upward from an upper surface of the rotational plate 254. More specifically, the eccentric shaft 256 may protrude from the rotational plate 254 at an eccentric position from an axial center of the base shaft 252, and rotate eccentrically when the rotational plate 254 rotates.

The connecting rod 340 may be mounted on the eccentric shaft 256. According to an eccentric rotation of the eccentric shaft 256, the connecting rod 340 linearly reciprocates in a frontward-backward direction (X-axis direction).

The compression unit 300 may include the cylinder block 310, the connecting rod 340, a piston 350, and a piston pin 370. The cylinder block 310 may be provided on the rotor 240, more specifically, an upper side of the motor 200, and may be mounted inside of the airtight container 100. The cylinder block 310 may include the rotational plate seating part 320 and a cylinder 330.

The rotational plate seating part 320 may be formed at a bottom of the cylinder block 310 and rotatably accommodate the rotational plate 254. A shaft opening 322 through which the rotational shaft 250 may pass may be formed in the rotational plate seating part 320.

The cylinder 330 may be provided at the front of the cylinder block 310 and may be arranged to accommodate the piston 350 described hereinafter. The piston 350 reciprocate in the frontward-backward direction (X-axis direction), and a compression space C capable of compressing the refrigerant is formed inside of the cylinder 330.

The cylinder 330 may be made of an aluminum material. For example, the cylinder 330 may be made of aluminum or aluminum alloy.

Magnetic flux generated from the rotor 240 is not transmitted to the cylinder 330 due to the non-magnetic aluminum material. Accordingly, as magnetic flux generated in the rotor 240 is not transmitted to the cylinder 330, it may be prevented from leaking outside of the cylinder 330.

The connecting rod 340 is a device that transmits the drive force provided from the motor 200 to the piston 350, and converts the rotational motion of the rotational shaft 250 into linear reciprocating motion. When the rotational shaft 250 rotates, the connecting rod 340 linearly reciprocates in the frontward-backward direction (X-axis direction). The connecting rod 340 may be made of a sintered alloy material, for example.

The piston 350 is a device that compresses the refrigerant, and is accommodated in the cylinder 330 so as to be able to reciprocate in the frontward-backward direction (X-axis direction). The piston 350 may be connected to the connecting rod 340. The piston 350 linearly reciprocates within the cylinder 330 according to the movement of the connecting rod 340. As the piston 350 reciprocates, the refrigerant flowing from the suction pipe 120 may be compressed in the cylinder 330.

The piston 350, like the cylinder 330, may be made of an aluminum material, for example, aluminum or an aluminum alloy. Therefore, it is possible to prevent magnetic flux generated from the rotor 240 from leaking outside through the piston 350.

In addition, the piston 350 may be made of the same material as the cylinder 330 and have substantially a same coefficient of thermal expansion as the cylinder 330. As they have almost the same coefficient of thermal expansion, when the compressor 10 is driven, the piston 350 is thermally deformed by an amount substantially equal to that of the cylinder 330 in the internal environment of the airtight container 100 at a high temperature (typically, about 100° C.). Accordingly, when the piston 350 reciprocates within the cylinder 330, interference between the piston 350 and the cylinder 330 may be prevented from occurring.

The piston pin 370 couples the piston 350 and the connecting rod 340. That is, the piston pin 370 connects the piston 350 and the connecting rod 340 by penetrating the piston 350 and the connecting rod 340 in the vertical direction (Z-axis direction).

The suction/discharge unit 400 may include a muffler assembly 410, a valve assembly 480, discharge hose 800, a plurality of gaskets 485 and 488, an elastic member 490, and a clamp 492. The muffler assembly 410 transmits the refrigerant suctioned from the suction pipe 120 to an inside of the cylinder 330, and the refrigerant compressed in compression space C of the cylinder 330 is transmitted to the discharge pipe 130.

That is, the muffler assembly 410 is provided with a suction space S that accommodates the refrigerant suctioned from the suction pipe 120, and a discharge space (D) that accommodates the refrigerant compressed in compression space C of the cylinder 330. The refrigerant suctioned from the suction pipe 120 flows into the suction space S of a suction/discharge tank 426 via suction mufflers 430 and 420 described hereinafter. The refrigerant compressed in the cylinder 330 passes through the discharge space D of the suction/discharge tank 426, passes through discharge mufflers 425 and 438, and is discharged outside of the compressor 10 through the discharge hose 800.

The valve assembly 480 guides the refrigerant in the suction space S into the cylinder 330 or guides the refrigerant compressed in the cylinder 330 to the discharge space D. That is, a discharge valve 483 mounted to open and close may be provided to allow the refrigerant compressed in the compression space C to be discharged to the discharge space D on a front side of the valve assembly 480, and a suction valve 481 mounted to open and close is provided to allow the refrigerant in the suction space S to be discharged to the compression space C of the cylinder 330 on a rear side of the valve assembly 480. That is, the discharge valve 483 is provided on the front side of the valve assembly 480, and the suction valve 481 is provided on the rear side of the valve assembly 420.

Operation of the discharge valve 483 and the suction valve 481 will be described hereinafter.

When the refrigerant compressed in the compression space C in the cylinder 330 is discharged, the discharge valve 483 is opened and the suction valve 481 is closed. Accordingly, the refrigerant compressed in the cylinder 330 may flow into the discharge space D without flowing into the suction space S.

Conversely, when the refrigerant flowing into the suction space S is suctioned into the cylinder 330, the discharge valve 483 is closed and the suction valve 481 is opened. Accordingly, the refrigerant in the suction space S may flow into the cylinder 330 without flowing into the discharge space D.

The discharge hose 800 is a device that transmits the compressed refrigerant accommodated in the discharge space D to the discharge pipe 130, and is coupled to the muffler assembly 410. One or a first side of the discharge hose 800 is coupled to the muffler assembly 410 to communicate with the discharge space D, and the other or a second side of the discharge hose 800 is coupled to the discharge pipe 130.

The plurality of gaskets 485 and 488 are devices that prevents refrigerant leakage and are mounted on one or a first side and the other or a second side of the valve assembly 480, respectively. That is, the plurality of gaskets 485 and 488 may include first gasket 485 and second gasket 488. The first gasket 485 may be mounted on a front of the valve assembly 480, and the second gasket 488 is mounted on a rear of the valve assembly 480.

The elastic member 490 supports the muffler assembly 410 when the compressor 10 is driven, and is mounted in front of the muffler assembly 410. The elastic member 490 may include a Belleville spring, for example.

The clamp 492 fixes the valve assembly 480, the first gasket 485, the second gasket 488, and the elastic member 490 to the muffler assembly 410. The clamp 492 may be formed in a substantially triangular shape, and mounted to the muffler assembly 410 through a fastening means, such as a screw member.

In addition, the compressor 10 may further include a plurality of damper members 500, 550, 600, and 650 and a balance weight 700. The plurality of damper members 500, 550, 600, and 650 dampen vibrations of internal structures generated when the compressor 10 is driven. The plurality of damper members 500, 550, 600, and 650 may include front damper 500, rear damper 550, and lower dampers 600 and 650.

The front damper 500 dampens vibration of the suction/discharge unit 400 and may be made of a rubber material, for example. The front damper 500 may be coupled to a front upper portion of the cylinder block 310 through a fastening means coupled to the clamp 492.

The rear damper 550 dampens vibration of the compression unit 300 and is mounted on a rear upper portion of the cylinder block 310. The rear damper 550 may be made of a rubber material, for example.

The lower dampers 600 and 650 dampen vibration of the motor 200 and may include a plurality. The plurality of lower dampers 600 and 650 may include front lower damper 600 and rear lower damper 650.

The front lower damper 600 may dampen vibration of a front side of the motor 200 and may be mounted on a front lower side of the stator core 210. The rear lower damper 650 may dampen vibration of a rear side of the motor 200, and may be mounted on a rear lower side of the stator core 210.

The balance weight 700 is a device that controls rotational vibration when the rotational shaft 250 of the motor 200 rotates, and may be coupled to the eccentric shaft 256 of the rotational shaft 250 at an upper side of the connecting rod 340.

Hereinafter, configurations of the muffler assembly 410 and the discharge hose 800 will be described.

Figure 4:
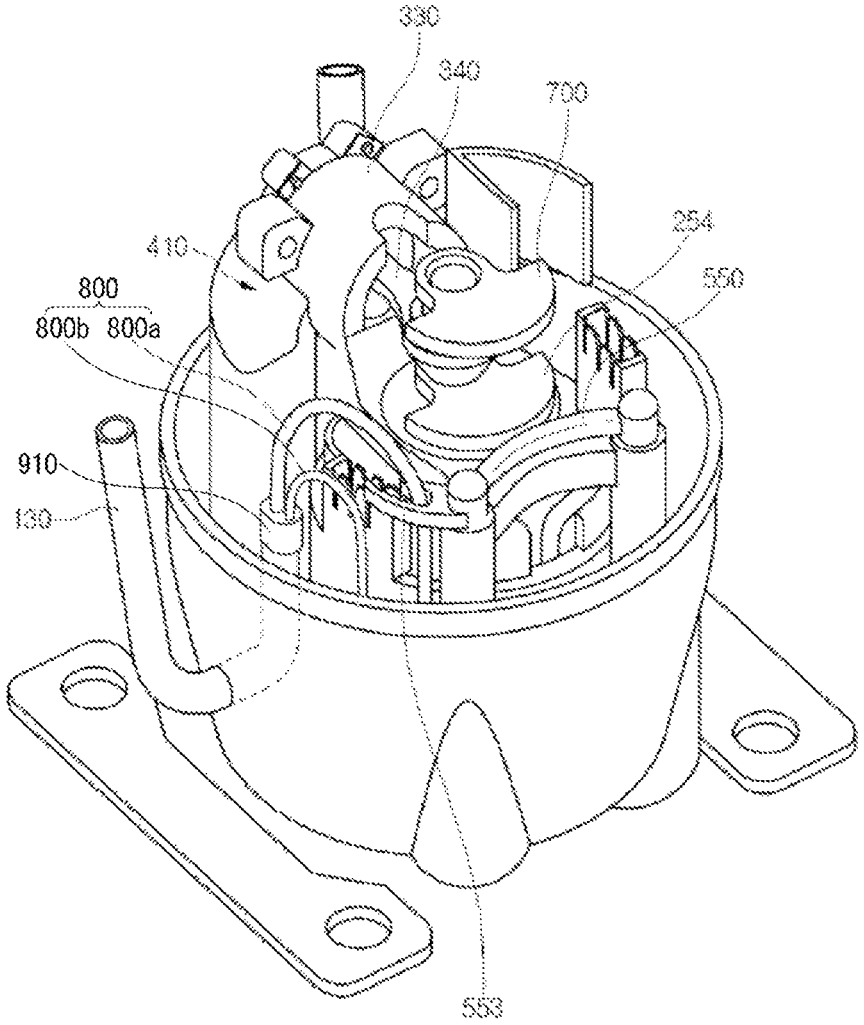
FIG. 4 is a view of a reciprocating compressor according to an embodiment.
Figure 5:
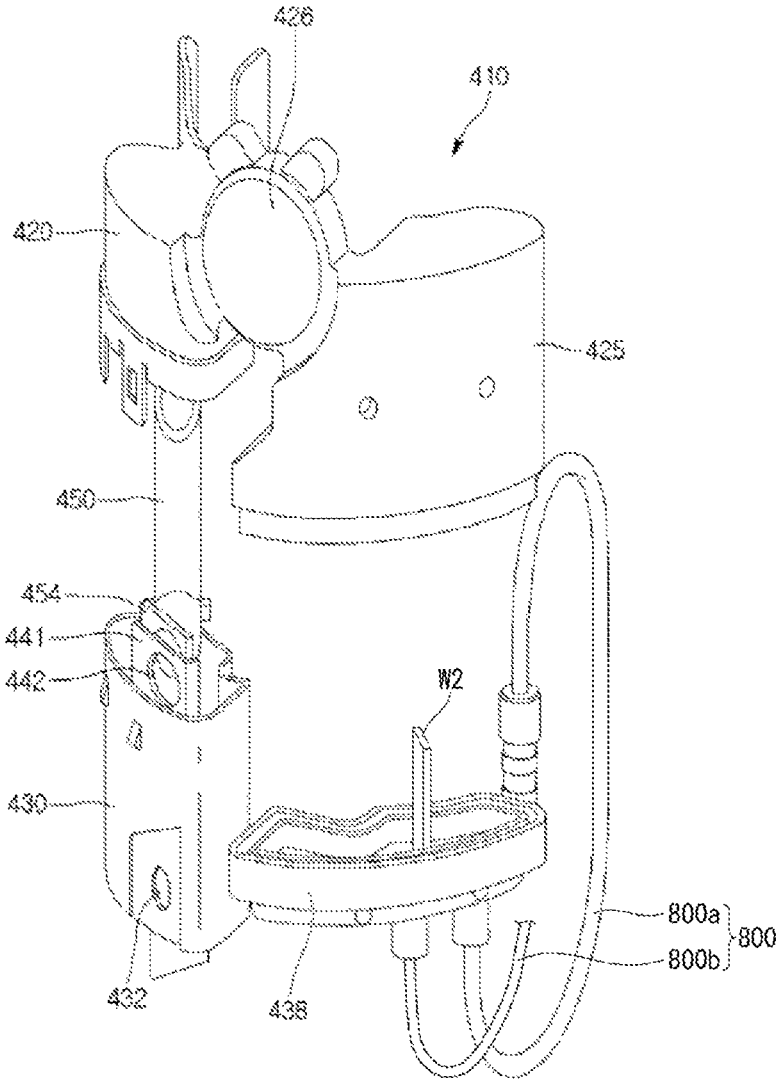
FIG. 5 is a front perspective view showing a connection between a muffler assembly and a discharge hose according to an embodiment.
Figure 6:
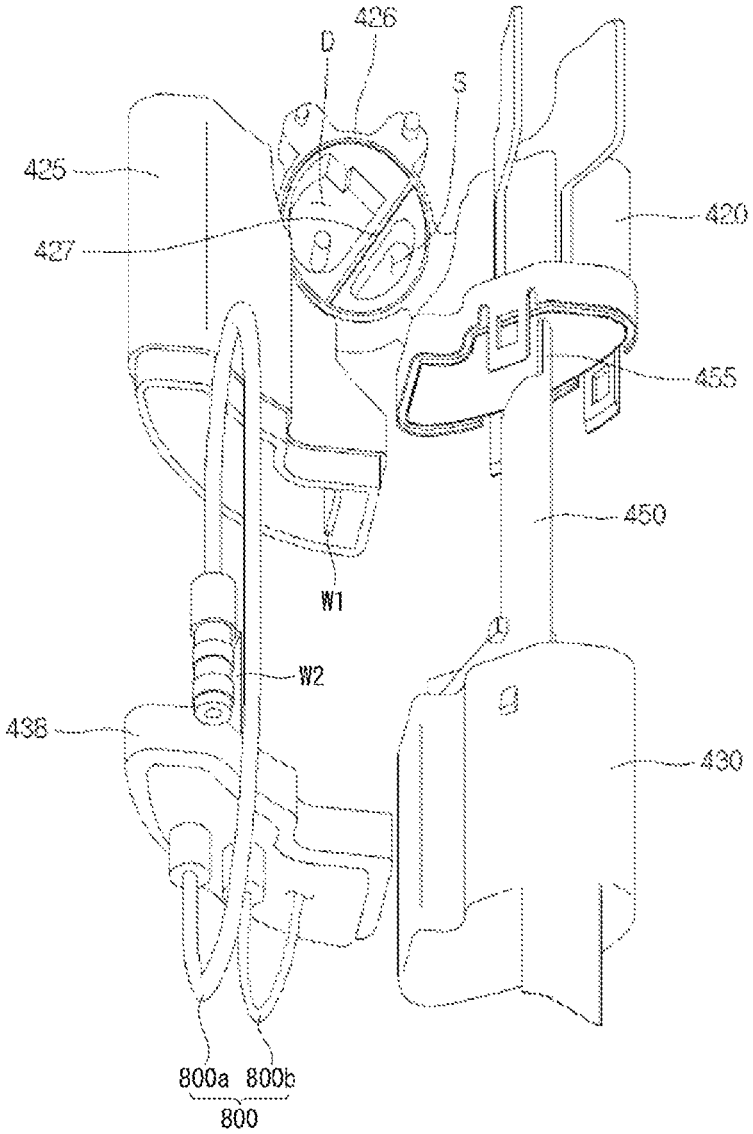
FIG. 6 is a rear perspective view showing a connection of a muffler assembly and a discharge hose according to an embodiment.
Figure 7:
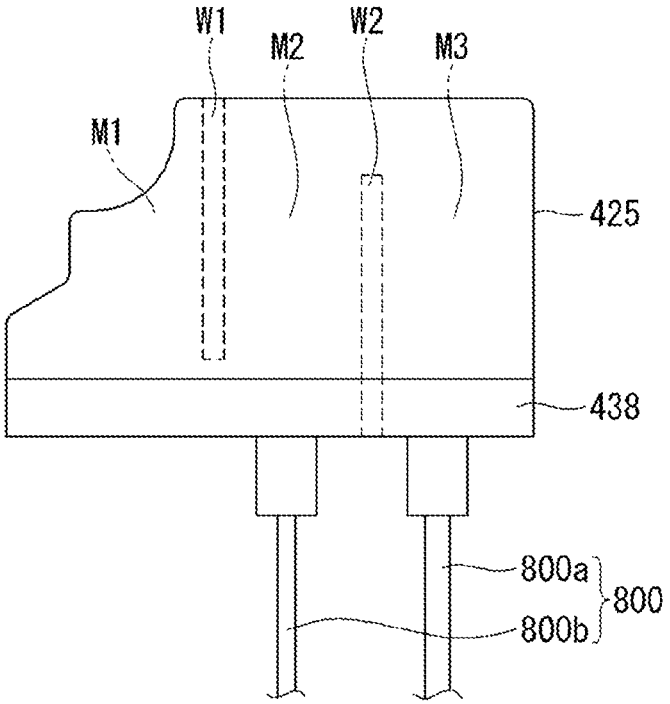
FIG. 7 is a schematic view showing connections between a discharge muffler and the discharge hose shown in FIGS. 5 and 6.

FIG. 4 is a view of a reciprocating compressor according to an embodiment. FIG. 5 is a front perspective view showing a connection between a muffler assembly and a discharge hose according to an embodiment. FIG. 6 is a rear perspective view showing a connection of a muffler assembly and a discharge hose according to an embodiment. FIG. 7 is a schematic view showing connections between a discharge muffler and the discharge hose shown in FIGS. 5 and 6.

Prior to describing specific embodiments, characteristics of a reciprocating compressor according to embodiments will be briefly described, the reciprocating compressor including two or more discharge hoses. Each of the discharge hoses may be formed of a flexible material.

As the reciprocating compressor of this configuration includes two or more discharge hoses that connect the discharge muffler and the discharge pipe, by reducing inner diameters of the discharge hoses, it is possible to reduce a rigidity of the discharge hoses and prevent clogging of the discharge gas during high-speed operation, and it can effectively reduce pulsation. The two or more discharge hoses may have different inner diameters, a same inner diameter, or different lengths.

In addition, at least one of the two or more discharge hoses may be formed with different inner diameters of an inlet and an outlet, or inner diameters of the inlet and outlet of each of the two or more discharge hoses may be the same. Accordingly, two or more discharge hoses may be effectively installed in spaces of various sizes formed inside of the airtight container of the reciprocating compressor. In addition, it can effectively reduce clogging and pulsation of discharged gas while maintaining a same total cross-sectional area of the passage formed by the discharge hose as in the related art.

A total cross-sectional area of the passage formed by the two or more discharge hoses may be formed to be less than or equal to a cross-sectional area of the discharge pipe.

Discharge hoses of various structures provided in the reciprocating compressor according to embodiments will be described hereinafter.

Referring to FIGS. 4 to 7, the muffler assembly 410 according to an embodiment may include a first assembly part or portion (suction muffler) 430, a second assembly part or portion (suction muffler) 420, a third assembly part or portion (discharge muffler) 425, and a fourth assembly part or portion (discharge muffler) 438.

The first assembly part 430 may include a suction hole 432 that communicates with the suction pipe 120. The suction hole 432 may be positioned adjacent to an inside of a point of the lower airtight container 110 to which the suction pipe 120 is coupled. An inner pipe 450 may be installed inside of the first assembly part 430. For example, the inner pipe 450 may include a substantially cylindrical pipe.

A first fixing part or portion 441 that fixes the inner pipe 450 may be installed inside of the first assembly part 430. A through hole 442 corresponding to the suction hole 432 may be formed in the first fixing part 441. Therefore, in a state in which the first fixing part 441 is installed inside of the first assembly part 430, the suction hole 432 and the through hole 442 may be aligned with each other.

The inner pipe 450 may include a first coupling part or portion 454 coupled to the first fixing part 441. The inner pipe 450 may extend upward from the first assembly part 430 and be coupled to the second assembly part 420. The second assembly part 420 may include a second fixing part or portion coupled to the inner pipe 450. The inner pipe 450 may include a second coupling part or portion 455 coupled to the second fixing part.

The second assembly part 420 may be coupled to an upper side of the first assembly part 430. At least a portion of the inner pipe 450 may be positioned inside of the first assembly part 430 and the remaining portion may be positioned inside of the second assembly part 420.

When the first assembly part 430 and the second assembly part 420 are coupled, a suction passage through which the refrigerant suctioned into the compressor 10 flows toward the cylinder 330 is formed inside of the first and second assembly parts 430 and 420. Accordingly, the first and second assembly parts 430 and 420 may be collectively referred to as a "suction muffler".

The third assembly part 425 is spaced apart from and disposed on or at one side of the second assembly part 420. In addition, the suction/discharge tank 426 that forms the suction space S and the discharge space D is installed between the second assembly part 420 and the third assembly part 425.

The suction/discharge tank 426 may include a partition 427 that divides an internal space of the suction/discharge tank 426 into the suction space S and the discharge space D.

Also, the valve assembly 480 may be installed on or at one side of the suction/discharge tank 426.

The suction space S may be shielded by the suction valve 481. The discharge space D may be shielded by the discharge valve 483.

The fourth assembly part 438 may be coupled to a lower side of the third assembly part 425. When the third assembly part 425 and the fourth assembly part 438 are coupled, a discharge passage through which the refrigerant discharged from the cylinder 330 flows toward the discharge pipe 130 may be formed inside of the third and fourth assembly parts 425 and 438. Accordingly, the third and fourth assembly parts 425 and 438 may be collectively referred to as a "discharge muffler".

The third assembly part 425 may be referred to as a "muffler body" of the discharge muffler, and the fourth assembly part 438 may be referred to as a "muffler cover" of the discharge muffler.

A plurality of partition walls W1 and W2 may be positioned in the inner space of the discharge muffler. In the drawing, an example is shown in which two partition walls W1 and W2 are provided; however, the number of partition walls may be variously changed.

When the two partition walls W1 and W2 are positioned inside of the discharge muffler, three attenuation spaces M1, M2, and M3 are formed in the internal space of the discharge muffler. In addition, the three attenuation spaces M1, M2 and M3 communicate with each other.

The partition wall W1 may be integrally fixed to the third assembly part 425, and an end of the partition wall W1 may be spaced apart from an inner bottom surface of the fourth assembly part 438. Thus, a flow passage through which the discharge gas flows may be formed between the end of the partition wall W1 and the inner bottom surface of the fourth assembly part 438.

The partition wall W2 may be integrally fixed to the fourth assembly part 438, and an end of the partition wall W2 may be spaced apart from an inner bottom surface of the third assembly part 425. Thus, a flow passage through which the discharge gas flows may be formed between the end of the partition wall W2 and the inner bottom surface of the third assembly part 425. The three attenuation spaces M1, M2, and M3 may include third attenuation space M3 positioned last along a flow direction of the discharge gas, first attenuation space M1 spaced apart from the third attenuation space M3, and second attenuation space M2 positioned between the first attenuation space M1 and the third attenuation space M3.

The discharge hose 800 of the multi-hose structure coupled to the discharge muffler may include a main hose 800*a* coupled to the third attenuation space M3 positioned last along the flow direction of the discharge gas among the three attenuation spaces M1, M2, M3, and an auxiliary hose 800*b* coupled to at least one attenuation space among the remaining two attenuation spaces M1 and M2, for example, the second attenuation space M2 and/or the first attenuation space M1. The main hose 800*a* and the auxiliary hose 800*b* may have different inner diameters. An inner diameter of the main hose 800*a* coupled to the third attenuation space M3 among the main hose 800*a* and the auxiliary hose 800*b* may be formed larger than an inner diameter of the auxiliary hose 800*b*, and a sum of cross-sectional areas of passages of the main hose 800*a* and the auxiliary hose 800*b* may be formed less than or equal to a cross-sectional area of the discharge hose.

The main hose 800*a* and the auxiliary hose 800*b* may have different lengths. Alternatively, they may also have a same length.

In addition, at least one hose among the main hose 800*a* and the auxiliary hose 800*b* may be formed differently from each other in an inner diameter of an inlet (the part coupled to the fourth assembly part) and outlet (the part coupled to the discharge pipe). In this case, among the main hose 800*a* and the auxiliary hose 800*b*, at least one hose may have an inner diameter of an inlet (the part coupled to the fourth assembly part) larger than an inner diameter of an outlet (the part coupled to the discharge pipe).

Alternatively, the main hose 800*a* and the auxiliary hose 800*b* may be formed with a same inner diameter of the inlet (the part coupled to the fourth assembly part) and outlet (the part coupled to the discharge pipe) respectively.

According to this configuration, the main hose 800*a* and the auxiliary hose 800*b* may be effectively installed in spaces of various sizes formed inside of the airtight container of the reciprocating compressor.

The main hose 800*a* and the auxiliary hose 800*b* transmit the refrigerant (or discharge gas) in the discharge muffler to the discharge pipe 130. In this embodiment, one or a first side of the discharge hoses 800*a* and 800*b* may be coupled to the fourth assembly part 438, and the other or a second side may be coupled to the discharge pipe 130.

In order to couple the discharge hoses 800*a* and 800*b*, a first connector 910 may be coupled to an end of the discharge pipe 130, and the other sides of the discharge hoses 800*a* and 800*b* may be coupled to the first connector 910. A coupling structure between the first connector 910 and the discharge pipe 130 and a coupling structure between the discharge hoses 800*a* and 800*b* and the first connector 910 may be formed in various ways.

The discharge hoses 800*a* and 800*b* may extend slightly longer from the fourth assembly part 438 toward the discharge pipe 130, and in order to be disposed in the limited inner space of the airtight container 100, they may be configured to be curved or bent at least once.

The discharge hoses 800*a* and 800*b* may be formed of a flexible material; however, this is not essential.

Some of the discharge hoses 800*a* and 800*b* may be supported by a hose fixing part or portion 553. The hose fixing part 553 may be coupled to the rear damper 550 and be configured to clamp the discharge hose 800. For example, the hose fixing part 553 may have a tong shape and may be disposed to surround at least a portion of outer circumferential surfaces of the discharge hoses 800*a* and 800*b*. By the hose fixing part 553, the discharge hoses 800*a* and 800*b* may be guided to be positioned in a state of being spaced apart from an inner surface of the airtight container 100.

The discharge pipe 130 may pass through the lower airtight container 110 and extend into the lower airtight container 110, and the discharge hoses 800*a* and 800*b* may be connected to the first connector 910 coupled to the discharge pipe 130. In order to facilitate connection between the discharge pipe 130 and the discharge hoses 800*a* and 800*b*, the discharge pipe 130 may be bent through the lower airtight container 110 and extend upward.

The discharge hoses 800*a* and 800*b* may be formed of a flexible rubber material, for example, and the discharge pipe 130 may be made of a metal material, for example, copper (Cu).

As the reciprocating compressor having this configuration includes two or more discharge hoses that connect the discharge muffler and the discharge pipe, the rigidity of discharge hoses may be effectively reduced. Accordingly, it is possible to effectively reduce vibration generated in the compressor body from being transmitted to the airtight container, and to effectively suppress or prevent an increase in vibration of the airtight container due to an increase in rigidity of the discharge hose.

In addition, as it is possible to effectively suppress or prevent clogging of the discharge gas during high-speed operation of the micro-reciprocating compressor, a cooling capacity may be increased in proportion to the increase in operating speed of the compressor. In addition, an overall pulsation of the reciprocating compressor may be effectively reduced.

Figure 8:
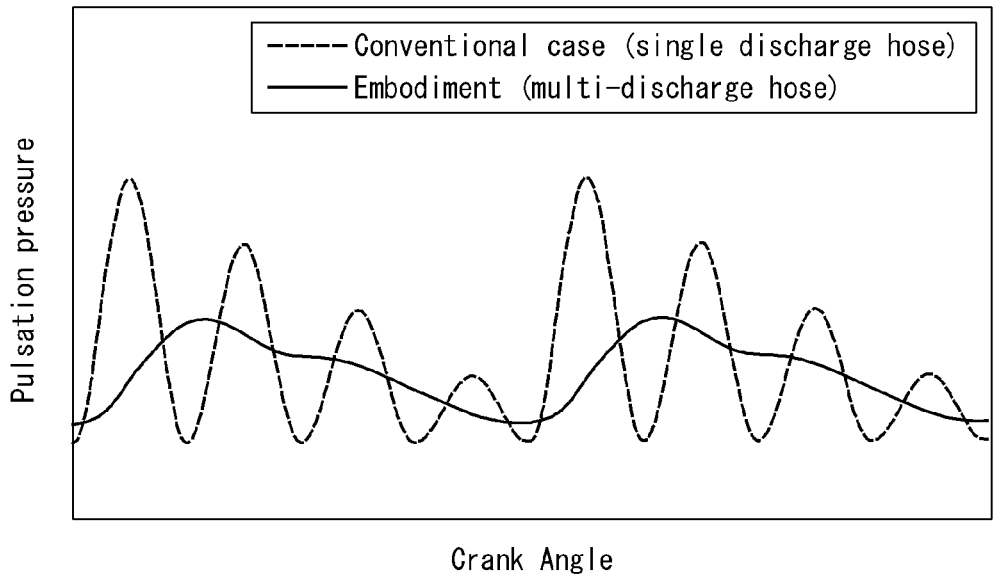
FIG. 8 is a graph showing a pulsation reduction effect of a reciprocating compressor according to an embodiment.

FIG. 8 is a graph showing a pulsation reduction effect of a reciprocating compressor according to an embodiment. Referring to FIG. 8, it can be seen that the reciprocating compressor according to embodiments having at least two discharge hoses has an excellent pulsation reduction effect compared to the conventional case having one discharge hose.

As the discharged gas after passing through all of the plurality of attenuation spaces M1 to M3 flows into the main hose 800*a*, noise generated during operation of the compressor may be effectively attenuated.

FIGS. 9 to 12 are schematic views showing connections between a discharge muffler and a discharge hose according to other embodiments.

Figure 9:
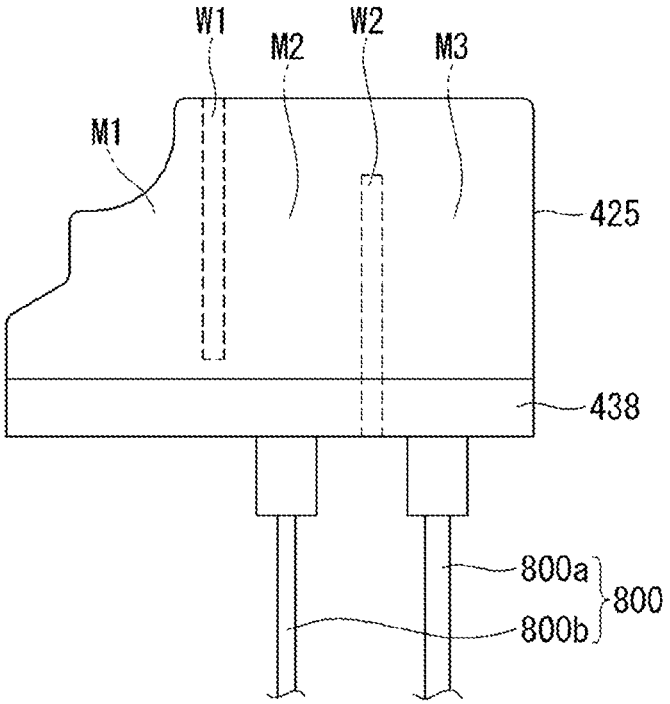
FIG. 9 is a schematic view showing a connection between a discharge muffler and a discharge hose according to another embodiment.

First, referring to FIG. 9, unlike the above-described embodiment, the reciprocating compressor of this embodiment may include discharge hose 800 having one main hose 800*a* and two auxiliary hoses 800*b* and 800*c*. The two auxiliary hoses 800*b* and 800*c* may include first auxiliary hose 800*c* coupled to the first attenuation space M1 and second auxiliary hose 800*b* connected to the second attenuation space M2. In addition, the first auxiliary hose 800*c* may be formed with a smaller inner diameter than that of the second auxiliary hose 800*b*, as shown in FIG. 9.

That is, the inner diameter of the first auxiliary hose 800*c* coupled to the first attenuation space M1 may be formed smaller than the inner diameter of the second auxiliary hose 800*b* coupled to the second attenuation space M2 and the inner diameter of the main hose 800*a* coupled to the third attenuation space M3, respectively, and the inner diameter of the second auxiliary hose 800*b* may be formed smaller than the inner diameter of the main hose 800*a*. Alternatively, the first auxiliary hose 800*c* may have a same inner diameter as the second auxiliary hose 800*b*.

Alternatively, the inner diameter of the first auxiliary hose 800*c* may be larger than the inner diameter of the second auxiliary hose 800*b* but smaller than the inner diameter of the main hose 800*a*. A sum of cross-sectional areas of passages of the main hose 800*a* and the auxiliary hoses 800*b* and 800*c* may be formed less than or equal to a cross-sectional area of the discharge hose. The main hose 800*a* and the auxiliary hoses 800*b* and 800*c* may have different lengths, but may also have the same length.

Figure 10:
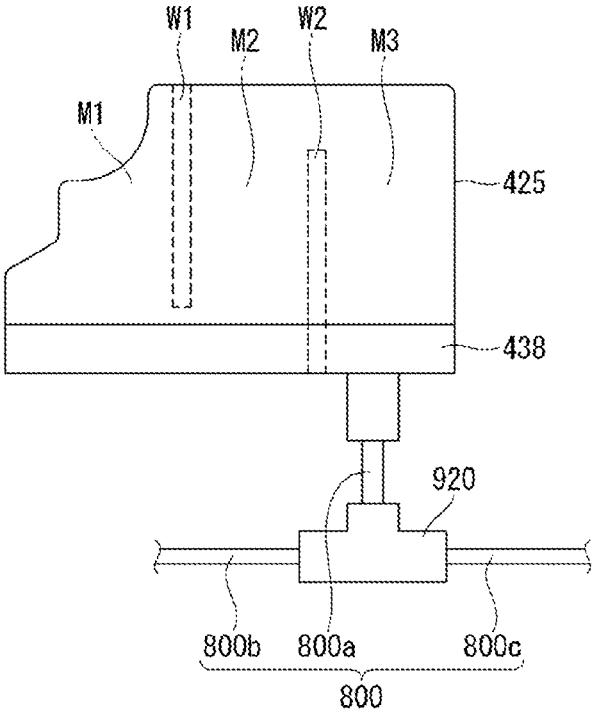
FIG. 10 is a schematic view showing a connection between a discharge muffler and a discharge hose according to still another embodiment.

Next, referring to FIG. 10, the reciprocating compressor of this embodiment may include discharge hose 800 having one main hose 800*a* and two auxiliary hoses 800*b* and 800*c*, but the two auxiliary hoses 800*b* and 800*c* may include first auxiliary hose 800*c* coupled to one or a first side of second connector 920 coupled to the end of the main hose 800*a* coupled to the third damping space M3, and second auxiliary hose 800*b* coupled to the other or a second side of the second connector 920.

The first auxiliary hose 800*c* and the second auxiliary hose 800*b* may have a same inner diameter; however, they may also have different inner diameters. In addition, the first auxiliary hose 800*c* and the second auxiliary hose 800*b* each may be formed smaller than the inner diameter of the main hose 800*a*.

A sum of cross-sectional areas of passages of the main hose 800*a* and the auxiliary hoses 800*b* and 800*c* may be formed less than or equal to the cross-sectional area of the discharge hose. In addition, the main hose 800*a* and the auxiliary hoses 800*b* and 800*c* may have different lengths; however, they may also have the same length.

Figure 11:
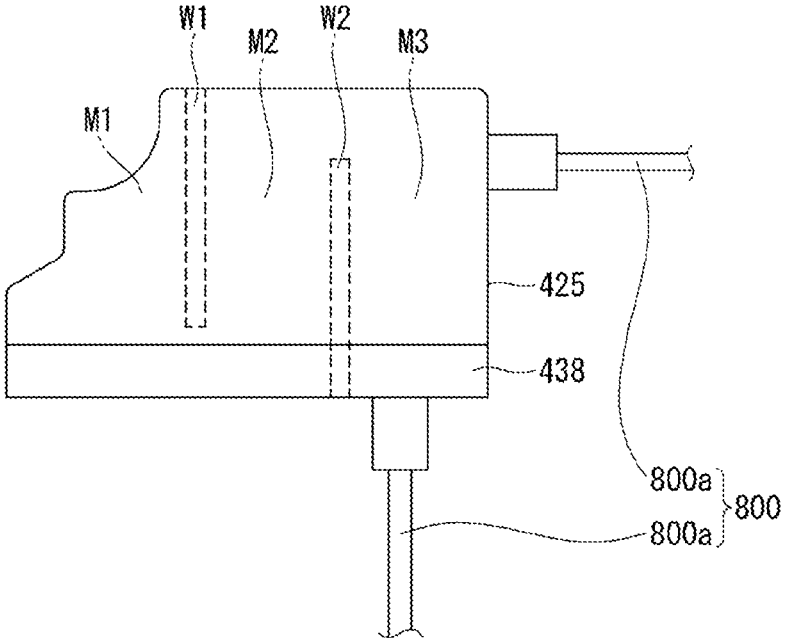
FIG. 11 is a schematic view showing a connection between a discharge muffler and a discharge hose according to still another embodiment.

Referring next to FIG. 11, the reciprocating compressor of this embodiment may include discharge hose 800 having at least two main hoses 800*a*. That is, the reciprocating compressor described in the above-described embodiments is configured such that the discharge hose includes a main hose and an auxiliary hose, but the discharge hose 800 provided in the reciprocating compressor of this embodiment includes only at least two main hoses 800*a* formed with the same inner diameter. In this case, one of the main hoses 800*a* may be coupled to the fourth assembly part, and among the main hoses 800*a*, the remaining main hoses 800*a* may be coupled to the third assembly part.

A sum of passage cross-sectional areas of the main hoses 800*a* may be formed less than or equal to the cross-sectional area of the discharge hose. The main hoses 800*a* may have different lengths, but may also have a same length.

Figure 12:
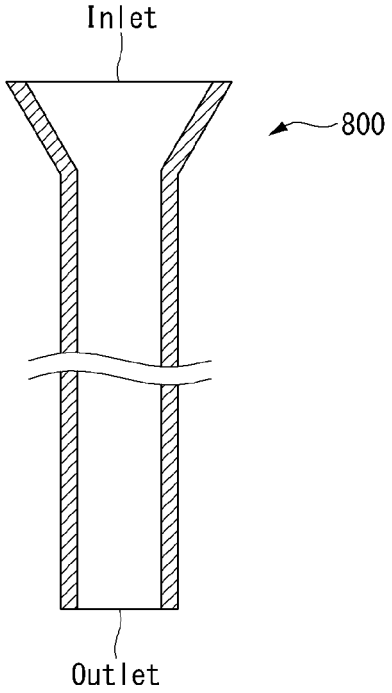
FIG. 12 is a schematic view showing a connection between a discharge muffler and a discharge hose according to still another embodiment.

It can be seen that the main hose 800*a* and the auxiliary hoses 800*b* and 800*c* of the discharge hoses 800 provided in the previous embodiments have the same inner diameters of the inlets (the part coupled to the fourth assembly part) and outlets (the part coupled to the discharge pipe). However, as shown in FIG. 12, at least one hose of the main hose 800*a* and the auxiliary hoses 800*b* and 800*c* may have different inner diameters of an inlet (the part coupled to the fourth assembly part) and an outlet (the part coupled to the discharge pipe).

In this case, at least one hose of the main hose 800*a* and the auxiliary hoses 800*b* and 800*c* may have an inner diameter of an inlet (the part coupled to the fourth assembly part) larger than an inner diameter of an outlet (the part coupled to the discharge pipe).

Embodiments disclosed herein provide a reciprocating compressor capable of effectively reducing transmission of vibration generated in a compressor body to an airtight container. Embodiments disclosed herein further provide a micro-reciprocating compressor capable of suppressing or preventing clogging of discharge gas even during high-speed operation. Embodiments disclosed herein furthermore provide a micro-reciprocating compressor capable of increasing cooling capacity in proportion to an increase in operating speed of the compressor.

The technical problems to be achieved from embodiments are not limited to the technical problems mentioned above, and other technical problem which are not mentioned above can be clearly understood from the following description by those skilled in the art to which the present disclosure pertains.

A reciprocating compressor according to embodiments disclosed herein may include an airtight container forming an airtight space; a discharge pipe coupled to the airtight container; a motor having a stator and a rotor and installed inside of the airtight container to generate a rotational force; a compression unit having a connecting rod that converts the rotational force of the motor into a linear drive force, a piston connected to the connecting rod, and a cylinder into which the piston is movably inserted, and that compresses a refrigerant; a discharge muffler that attenuates discharge noise of a discharge gas discharged after being compressed in the cylinder; and two or more discharge hoses that connect the discharge muffler and the discharge pipe.

As the reciprocating compressor of embodiments disclosed herein connects two or more discharge hoses to the discharge muffler, it can be said to have a discharge hose having a multi-hose structure. As the reciprocating compressor of embodiments disclosed herein has a discharge hose having a multi-hose structure, while a rigidity is reduced by reducing the inner diameter of the discharge hose, clogging of the discharge gas during high-speed operation may be suppressed or prevented and pulsation may be effectively reduced.

The two or more discharge hoses each may be made of a flexible material. According to this configuration, clogging and pulsation of the discharge gas may be more effectively reduced.

A first connector may be connected to the discharge pipe, and the two or more discharge hoses each may be connected to the first connector. According to this configuration, it is possible to effectively reduce clogging and pulsation of the discharge gas while maintaining a same total cross-sectional area of the passage formed by the discharge hose as in the related art.

The two or more discharge hoses may have different inner diameters, the same inner diameter, or different lengths. According to this configuration, the inner diameter and/or length of each discharge hose may be adjusted in consideration of the connection positions of the different discharge hoses connected to the discharge muffler.

In addition, at least one of the two or more discharge hoses may have an inlet and an outlet having different inner diameters, or inner diameters of an inlet and an outlet of each of the two or more discharge hoses may be identical to each other. According to this configuration, two or more discharge hoses may be effectively installed in spaces of various sizes formed inside of the airtight container of the reciprocating compressor.

The discharge muffler may include a muffler body and a muffler cover coupled to each other to form an internal space, and a plurality of partition walls positioned in the internal space and that partition the internal space into a plurality of attenuation spaces. According to this configuration, as the discharge muffler may increase a discharge path of gas and/or refrigerant compared to the case in which the partition wall is not provided, noise generated during operation of the compressor may be effectively attenuated.

The two or more discharge hoses may include at least one main hose connected to a last attenuation space positioned last along a flow direction of the discharge gas among the plurality of attenuation spaces. The main hose may mean a hose having a larger inner diameter and/or diameter than other hoses. According to this configuration, as the discharge gas flows into the main hose after passing through all of the plurality of attenuation spaces, noise generated during operation of the compressor may be effectively attenuated.

For example, one main hose may be coupled to the last attenuation space, and the two or more discharge hoses may further include at least one auxiliary hose connected to other attenuation spaces other than the last attenuation space. The auxiliary hose may mean a hose having an inner diameter and/or diameter smaller than the inner diameter and/or diameter of the main hose.

According to this configuration, as at least one auxiliary hose is connected to another attenuation space positioned before the last attenuation space on the gas and/or refrigerant flow path, the gas and/or refrigerant whose noise is less attenuated than the gas and/or refrigerant flowing to the last attenuation space flows into the discharge pipe through at least one auxiliary hose. Accordingly, gas and/or refrigerant may be smoothly discharged without significantly affecting noise generation.

As another example, one main hose may be coupled to the last attenuation space, and the two or more discharge hoses may further include at least two auxiliary hoses connected to a second connector coupled to the one main hose. The at least two auxiliary hoses may be formed with an inner diameter smaller than an inner diameter of the main hose. According to this configuration, the coupling operation may be easily performed while increasing the number of auxiliary hoses.

As another example, two or more discharge hoses each may be connected to a last attenuation space positioned last along a flow direction of the discharge gas among a plurality of attenuation spaces, and formed of a main hose formed with the same inner diameter. According to this configuration, gas and/or refrigerant may be more smoothly discharged than when an auxiliary hose is provided.

In this way, the two or more discharge hoses include at least one main hose and at least one auxiliary hose, or at least two main hoses, so that a total cross-sectional area of the discharge gas discharge passage formed by the discharge hose may be formed equal to or larger than the related art. Accordingly, it is possible to effectively suppress or prevent clogging and increase in pulsation of the discharge gas, which may occur during high-speed operation of the compressor.

When the discharge muffler includes first to third attenuation spaces partitioned by two partition walls, the two or more discharge hoses may include at least one main hose connected to the third attenuation space positioned last along a flow direction of the discharge gas among the first to third attenuation spaces. In this case, at least one main hose may be coupled to the third attenuation space, at least one first auxiliary hose may be coupled to the first attenuation space spaced apart from the third attenuation space, and a second auxiliary hose may be coupled to the second attenuation space positioned between the first attenuation space and the third attenuation space.

In addition, the first auxiliary hose and the second auxiliary hose each are formed with an inner diameter smaller than an inner diameter of the main hose. The first auxiliary hose may be formed with an inner diameter smaller than an inner diameter of the second auxiliary hose, or a same inner diameter as the inner diameter of the second auxiliary hose. According to this configuration, it is possible to adjust the inner diameter and/or length of each discharge hose in consideration of the connection positions of the different discharge hoses connected to the discharge muffler.

According to the reciprocating compressor according to embodiments disclosed herein, as the rigidity of the discharge hose may be effectively reduced, vibration generated in the compressor body may be effectively reduced from being transmitted to the airtight container, and an increase in vibration of the airtight container due to an increase in rigidity of the discharge hose may be effectively suppressed.

Further, as it is possible to effectively suppress or prevent clogging of the discharge gas during high-speed operation of the reciprocating compressor, the cooling capacity may be increased in proportion to the increase in operating speed of the compressor. Furthermore, an overall pulsation of the reciprocating compressor may be effectively reduced.

Advantages obtainable from embodiments disclosed herein are not limited by the advantages mentioned above, and other advantages which are not mentioned above may be clearly understood from the following description by those skilled in the art to which the embodiments pertain.

It is apparent to those skilled in the art that the present disclosure may be embodied in other specific forms without departing from the essential characteristics of the present disclosure. Accordingly, the above detailed description should not be construed as restrictive in all respects but should be considered as illustrative. The scope of the present disclosure should be determined by reasonable interpretation of the appended claims, and all changes within the equivalent scope of the present disclosure are included in the scope of the present disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A reciprocating compressor, comprising:

an airtight container that forms an airtight space;

a discharge pipe coupled to the airtight container;

a motor having a stator and a rotor and installed inside of the airtight container to generate a rotational force;

a compression unit having a connecting rod that converts the rotational force of the motor into a linear drive force, a piston connected to the connecting rod, and a cylinder into which the piston is movably inserted and that compresses a refrigerant;

a discharge muffler that attenuates discharge noise of a discharge gas discharged after being compressed in the cylinder; and two or more discharge hoses that connect the discharge muffler and the discharge pipe.

2. The reciprocating compressor of claim 1, wherein the two or more discharge hoses are each made of a flexible material.

3. The reciprocating compressor of claim 2, wherein a first connector is connected to the discharge pipe, and wherein the two or more discharge hoses are each connected to the first connector.

4. The reciprocating compressor of claim 3, wherein the discharge muffler includes a muffler body and a muffler cover coupled to the muffler body to form an internal space, and a plurality of partition walls positioned in the internal space and that partition the internal space into a plurality of attenuation spaces.

5. The reciprocating compressor of claim 4, wherein the two or more discharge hoses include at least one main hose connected to a last attenuation space positioned last along a flow direction of the discharge gas among the plurality of attenuation spaces.

6. The reciprocating compressor of claim 5, wherein the two or more discharge hoses further include at least one auxiliary hose connected to another attenuation spaces other than the last attenuation space.

7. The reciprocating compressor of claim 6, wherein the at least one auxiliary hose have an inner diameter smaller than an inner diameter of the main hose.

8. The reciprocating compressor of claim 5, wherein the two or more discharge hoses further include at least two auxiliary hoses connected to a second connector coupled to the at least one main hose.

9. The reciprocating compressor of claim 8, wherein the at least two auxiliary hoses have an inner diameter smaller than an inner diameter of the main hose.

10. The reciprocating compressor of claim 5, wherein the at least one main hose includes two main hoses connected to the last attenuation space and formed with a same inner diameter.

11. The reciprocating compressor of claim 4, wherein the discharge muffler includes first to third attenuation spaces partitioned by two partition walls, and wherein the two or more discharge hoses include at least one main hose connected to the third attenuation space positioned last along a flow direction of the discharge gas among the first to third attenuation spaces.

12. The reciprocating compressor of claim 11, wherein the two or more discharge hoses further include a first auxiliary hose connected to the first attenuation space spaced apart from the third attenuation space, and a second auxiliary hose connected to a second attenuation space positioned between the first attenuation space and the third attenuation space.

13. The reciprocating compressor of claim 12, wherein the first auxiliary hose and the second auxiliary hose are each have an inner diameter smaller than an inner diameter of the main hose.

14. The reciprocating compressor of claim 13, wherein the inner diameter of the first auxiliary hose is smaller than the inner diameter of the second auxiliary hose.

15. The reciprocating compressor of claim 3, wherein the two or more discharge hoses have different inner diameters.

16. The reciprocating compressor of claim 3, wherein the two or more discharge hoses have a same inner diameter.

17. The reciprocating compressor of claim 3, wherein at least one of the two or more discharge hoses is formed such that an inner diameter of an inlet is different from an inner diameter of an outlet.

18. The reciprocating compressor of claim 3, wherein the two or more discharge hoses are each formed such that an inner diameter of an inlet is the same as an inner diameter of an outlet.

19. The reciprocating compressor of claim 1, wherein the reciprocating compressor comprises a micro-reciprocating compressor.

20. A micro-reciprocating compressor, comprising:

an airtight container that forms an airtight space;

a discharge pipe coupled to the airtight container;

a motor having a stator and a rotor and installed inside of the airtight container to generate a rotational force;

a compression unit having a connecting rod that converts the rotational force of the motor into a linear drive force, a piston connected to the connecting rod, and a cylinder into which the piston is movably inserted and that compresses a refrigerant;

a discharge muffler that attenuates discharge noise of a discharge gas discharged after being compressed in the cylinder; and a plurality of flexible discharge hoses that connect the discharge muffler and the discharge pipe.

* * * * *